US005518101A

United States Patent [19]

Simizu et al.

[11] Patent Number: 5,518,101

[45] Date of Patent: May 21, 1996

[54] UNACCEPTABLE COIN REMOVING APPARATUS FOR COIN HANDLING MACHINE

[75] Inventors: Tokuharu Simizu, Osaka; Hirohumi Haruna, Nagaokakyo, both of Japan

[73] Assignee: Laurel Bank Machines Co., Ltd., Tokyo, Japan

[21] Appl. No.: 355,238

[22] Filed: Dec. 9, 1994

[30] Foreign Application Priority Data

Dec. 17, 1993 [JP] Japan ..... 5-317193

[51] Int. Cl.[6] ..... G07D 5/02; G07D 5/08; G07D 1/00

[52] U.S. Cl. ..... 194/317; 194/334; 453/56

[58] Field of Search ..... 194/317, 318, 194/319, 334, 346; 453/3, 5, 7, 9, 11, 49, 56, 57

[56] References Cited

U.S. PATENT DOCUMENTS

| | | | |
|---|---|---|---|
| 4,369,800 | 1/1983 | Watanabe et al. | 453/56 X |
| 4,460,004 | 7/1984 | Furuya | 194/317 X |
| 4,681,204 | 7/1987 | Zimmermann | 194/334 X |
| 4,758,201 | 7/1988 | Ozeki | 453/56 |
| 4,904,223 | 2/1990 | Sentoku | 453/7 |
| 4,993,999 | 2/1991 | Ozeki et al. | 194/317 X |
| 5,076,414 | 12/1991 | Kimoto | 194/317 |
| 5,207,611 | 5/1993 | Ueda et al. . | |
| 5,230,653 | 7/1993 | Shinozaki et al. | 453/4 |

FOREIGN PATENT DOCUMENTS

| | | | |
|---|---|---|---|
| 200873 | 11/1986 | European Pat. Off. . | |
| 340501 | 11/1989 | European Pat. Off. . | |
| 3833915 | 4/1989 | Germany | 453/7 |
| 63-250792 | 10/1988 | Japan . | |
| 2-58193 | 2/1990 | Japan . | |
| 4-77890 | 3/1992 | Japan . | |
| 2242051 | 9/1991 | United Kingdom . | |
| 2254722 | 10/1992 | United Kingdom . | |

*Primary Examiner*—David A. Bucci
*Assistant Examiner*—Scott L. Lowe
*Attorney, Agent, or Firm*—Cushman, Darby & Cushman

[57] ABSTRACT

An unacceptable coin removing apparatus for a coin handling machine includes a rotatable disk for receiving coins deposited into the coin handling machine and feeding coins one by one into a coin passage provided with a reference guide rail and a facing guide rail facing the reference guide rail, transporting belts for transporting coins in the coin passage, sensors for detecting coins, a first projecting member which can be projected from the reference guide rail into the coin passage, a second projecting member which can be projected from the facing guide rail into the coin passage, a coin collecting opening and a controller for controlling the operation of the first projecting member, the second projecting member, the transporting belts and the rotatable disk. When the sensors detect an acceptable coin, the controller does not actuate the first and second projecting members. When the sensors detect an unacceptable coin or a foreign article, the controller projects the first or second projecting member, thereby leading the coin to the coin collecting opening and removing it. When it is unclear whether or not a coin is acceptable, the controller projects the first and second projecting members, reversely drives the transporting belts and the rotatable disk so as to return the coin onto the rotatable disk and then repeats the above described operation until it becomes clear whether or not the coin is acceptable.

9 Claims, 11 Drawing Sheets

UNACCEPTABLE COIN REMOVING APPARATUS FOR COIN HANDLING MACHINE

BACKGROUND OF THE INVENTION

The present invention relates to an unacceptable coin removing apparatus for a coin handling machine, which can remove unacceptable coins such as counterfeit coins, foreign coins, coins of denominations other than a predetermined one, and, in particular, to such an apparatus capable of efficiently and reliably collecting unacceptable coins.

DESCRIPTION OF THE PRIOR ART

It is indispensable to remove unacceptable coins such as counterfeit coins, foreign coins or the like in a coin handling machine such as a coin wrapping machine or similar machine and various apparatuses therefor have been proposed for this purpose.

Japanese Patent Application Laid Open No. 63-250792 proposes a coin handling machine having coin stopping means downstream of coin discriminating means in a coin passage for stopping coins and a coin removing opening capable of being opened or closed downstream of the coin stopping means so that when the coin discriminating means detects an unacceptable coin such as a counterfeit coin, foreign coin, coin of a denomination other than a predetermined one, the coin stopping means is projected into the coin passage thereby stopping the transport of the coin and the coin removing opening is opened, thereby removing the unacceptable coin therethrough.

However, in this coin handling machine, since when an unacceptable coin such as a counterfeit coin, foreign coin, coin of a denomination other than a predetermined one like is detected by the coin discriminating means, the coin stopping means is projected into the coin passage, thereby stopping and removing the coin, there is a problem of the coin handling efficiency being lowered.

Further, Japanese Patent Application Laid Open No. 2-58193 proposes a coin wrapping machine having a pair of stopper means downstream of a coin discriminating means in a coin passage for stopping coins and a coin removing opening capable of being opened or closed downstream of the stopper means so that when the coin discriminating means detects an unacceptable coin such as a counterfeit coin, foreign coin, coin of a denominations other than a predetermined one or the like, the stopper means are projected into the coin passage thereby stopping the transport of the coin following the unacceptable coin and the coin removing opening is opened, thereby removing the unacceptable coin therethrough.

However, in this coin handling machine, since when an unacceptable coin such as a counterfeit coin, foreign coin, coin of a denominations other than a predetermined one is detected by the coin discriminating means, the stopper means are projected into the coin passage, thereby stopping the coin following the unacceptable coin and removing the unacceptable coin, there is also a problem of the coin handling efficiency being lowered.

Moreover, Japanese Patent Application Laid Open No. 4-77890 proposes a coin sorting apparatus having a projection means capable of being projected downstream of coin discriminating means in a coin passage and a coin removing opening capable of being opened or closed downstream of the projection means so that when the coin discriminating means detects an unacceptable coin such as a counterfeit coin, foreign coin, coin of a denominations other than a predetermined one it is led to the coin removing opening by projecting the projection means into the coin passage and dropped through the coin removing opening, thereby removing the unacceptable coin. This coin sorting apparatus has an advantage in that unacceptable coins can be removed without stopping the transport of coins.

The coin discriminating means normally discriminates whether or not coins are acceptable by comparing detected data obtained by detecting the coin diameter and detected data obtained by magnetically detecting the coin material with corresponding reference data. However, if the coin is discriminated as unacceptable when only one of the detected coin data does not coincide with the reference data, the number of coins discriminated as unacceptable and removed increases and there is a risk of the coin handling efficiency being lowered since acceptable coins are discriminated as unacceptable when the accuracy of detecting coin diameter or coin material decreases for some reason.

On the other hand, if the coin is discriminated as acceptable when only one of the detected data obtained by detecting the coin diameter or obtained by magnetically detecting the coin material coincides with the reference data, the coin discriminating accuracy is lowered and there is a risk of unacceptable coins being handled as acceptable ones, whereby there inevitably arises a problem of unacceptable coins not being reliably removed.

Accordingly, even in the coin sorting apparatus disclosed in Japanese Patent Application Laid Open No. 4-77890, there remains a problem that the efficiency of handling coins cannot be improved without lowering the coin discrimination accuracy.

SUMMARY OF THE INVENTION

It is therefore an object of the present invention to provide an unacceptable coin removing apparatus for a coin handling machine which can efficiently and reliably remove unacceptable coins.

The above and other objects of the present invention can be accomplished by an unacceptable coin removing apparatus for a coin handling machine comprising a rotatable disk for receiving coins deposited into the coin handling machine and feeding out coins to a coin passage one by one by the centrifugal force produced by the rotation thereof, a reference guide rail for guiding coins by an inner wall thereof, a guide rail provided so as to face the reference guide rail via the coin passage, transporting belt means for transporting coins so as to hold coins between itself and a surface of the coin passage and coin detecting means for detecting coin diameter and coin material, the unacceptable coin removing apparatus for the coin handling machine further comprising first projecting means provided in the coin passage downstream of the coin detecting means and adapted to be projected into the coin passage from the reference guide rail, second projecting means paired with the first projecting means and adapted to be projected into the coin passage from the guide rail, unacceptable coin collecting means provided in the coin passage downstream of the first projecting means and the second projecting means and adapted for collecting unacceptable coins and foreign articles, and control means for discriminating whether or not coins are acceptable based on detection data detected by the coin detecting means, the control means being adapted to control operation of the first projecting means, the second projecting means, the transporting belt means and the rotatable disk so that when the coin detecting means detects an acceptable coin, it does not actuate the first projecting means and the second projecting means, that when the coin detecting means detects an unacceptable coin or a foreign article, it projects the first projecting means or the second projecting means into the coin passage, thereby leading the unacceptable coin or the foreign article to the unacceptable coin collecting means and removing it and that when it is unclear whether or not the coin detected by the coin detecting means is acceptable, it projects the first projecting means and the second projecting means into the coin passage, reversely drives the transporting belt means and the rotatable disk thereby returning the coin onto the rotatable disk, then drives the rotatable disk and the transporting belt means and repeatedly discriminates whether or not the coin is acceptable based on the detected data detected by the coin detecting means until it becomes clear whether or not the coin is acceptable.

In a preferred aspect of the present invention, the unacceptable coin removing apparatus further includes reference data storing means for storing reference data relating to coin diameters and magnetic properties, the coin detecting means being adapted for detecting coin diameters and magnetic properties and outputting detection signals to the control means, the control means being adapted to read corresponding reference data from the reference data storing means, to compare the thus read reference data with the detected data detected by the coin detecting means and to judge that the coin is acceptable when the detected data relating to coin diameter coincide with the corresponding reference data and the detected data relating to coin magnetic property coincide with the corresponding reference data, that it is unclear whether or not the coin is acceptable when one of the detected data relating to coin diameter and the detected data relating to coin magnetic property do not coincide with the corresponding reference data and that a detected object is an unacceptable coin or a foreign article when the detected data relating to coin diameter do not coincide with the corresponding reference data and the detected data relating to coin magnetic property do not coincide with the corresponding reference data.

In another preferred aspect of the present invention, the unacceptable coin removing apparatus further includes denomination setting means for setting a denomination of coins to be handled and reference data storing means for storing reference data relating to coin diameter and magnetic properties, the control means being adapted for reading corresponding reference data in accordance with a denomination of coins to be handled set by the denomination setting means, comparing the read reference data with detected data detected by the coin detecting means and judging that the coin is acceptable when the detected data relating to coin diameter coincide with the corresponding reference data and the detected data relating to coin magnetic property coincide with the corresponding reference data, that it is unclear whether or not a coin is acceptable when one of the detected data relating to coin diameter and the detected data relating to magnetic property do not coincide with the corresponding reference data and that a detected object is an unacceptable coin or a foreign article when both the detected data relating to coin diameter and the detected data relating to magnetic property do not coincide with the corresponding reference data.

In a further preferred aspect of the present invention, where the control means judges that a detected object is an unacceptable coin or a foreign article since the detected data relating to coin diameter and the detected data relating to magnetic property detected by the coin detecting means do not coincide with the corresponding reference data, the control means is adapted to project the first projecting means into the coin passage when the diameter of the detected object is greater than that of the reference data and to project the second projecting means into the coin passage when the diameter of the detected object is smaller than that of the reference data so as to lead the detected object to the unacceptable coin collecting means and remove it.

In a still further preferred aspect of the present invention, the unacceptable coin removing apparatus further includes reference data storing means for storing reference data relating to coin diameter and coin magnetic properties, the coin detecting means being adapted for detecting coin diameters and magnetic properties and outputting detection signals to the control means, the control means being adapted to read corresponding reference data from the reference data storing means, to compare the thus read reference data with the detected data detected by the coin detecting means and to judge that the coin is acceptable when the detected data relating to coin diameter coincide with the corresponding reference data and the detected data relating to coin magnetic property coincide with the corresponding reference data, that a coin is an unacceptable coin when the detected data relating to coin diameter coincide with the corresponding reference data but the detected data relating to coin magnetic property do not coincide with the corresponding reference data, that it is unclear whether or not a coin is an acceptable coin when the detected data relating to coin diameter do not coincide with the corresponding reference data and the detected diameter of the coin is equal to or greater than a first predetermined value and is equal to or smaller than a second predetermined value and that the detected object is a foreign article when the detected data relating to coin diameter do not coincide with the corresponding reference data and the detected diameter of the coin is smaller than the first predetermined value and greater than the second predetermined value.

In a yet further preferred aspect of the present invention, the unacceptable coin removing apparatus further includes denomination setting means for setting a denomination of coins to be handled and reference data storing means for storing reference data relating to coin diameters and magnetic properties, the coin detecting means being adapted for detecting coin diameters and magnetic properties and outputting detection signals to the control means, the control means being adapted to read corresponding reference data from the reference data storing means, to compare the thus read reference data with the detected data detected by the coin detecting means and to judge that the coin is acceptable when the detected data relating to coin diameter coincide with the corresponding reference data and the detected data relating to coin magnetic property coincide with the corresponding reference data, that a coin is an unacceptable coin when the detected data relating to coin diameter coincide with the corresponding reference data but the detected data relating to coin magnetic property do not coincide with the corresponding reference data, that it is unclear whether or not a coin is an acceptable coin when the detected data relating to coin diameter do not coincide with the corresponding reference data and the detected diameter of the coin is equal to or greater than a first predetermined value and is equal to or smaller than a second predetermined value and that the detected object is a foreign article when the detected data relating to coin diameter do not coincide with the corresponding reference data and the detected diameter of the coin is smaller than the first predetermined value and greater than the second predetermined value.

In a further preferred aspect of the present invention, the control means is adapted to project the first projecting means into the coin passage when it judges that the detected object detected by the coin detecting means is an unacceptable coin, to project the second projecting means into the coin passage when it judges that the detected object is a foreign article and the diameter thereof is smaller than the first predetermined value and to project the first projecting means into the coin passage when it judges that the detected object is a foreign article and the diameter thereof is greater than the first predetermined value, thereby leading the unacceptable coin or the foreign article to the unacceptable coin collecting means and removing it.

The above and other objects and features of the present invention will become apparent from the following description made with reference to the accompanying drawings.

DESCRIPTION OF THE PREFERRED EMBODIMENTS

Figure 1:
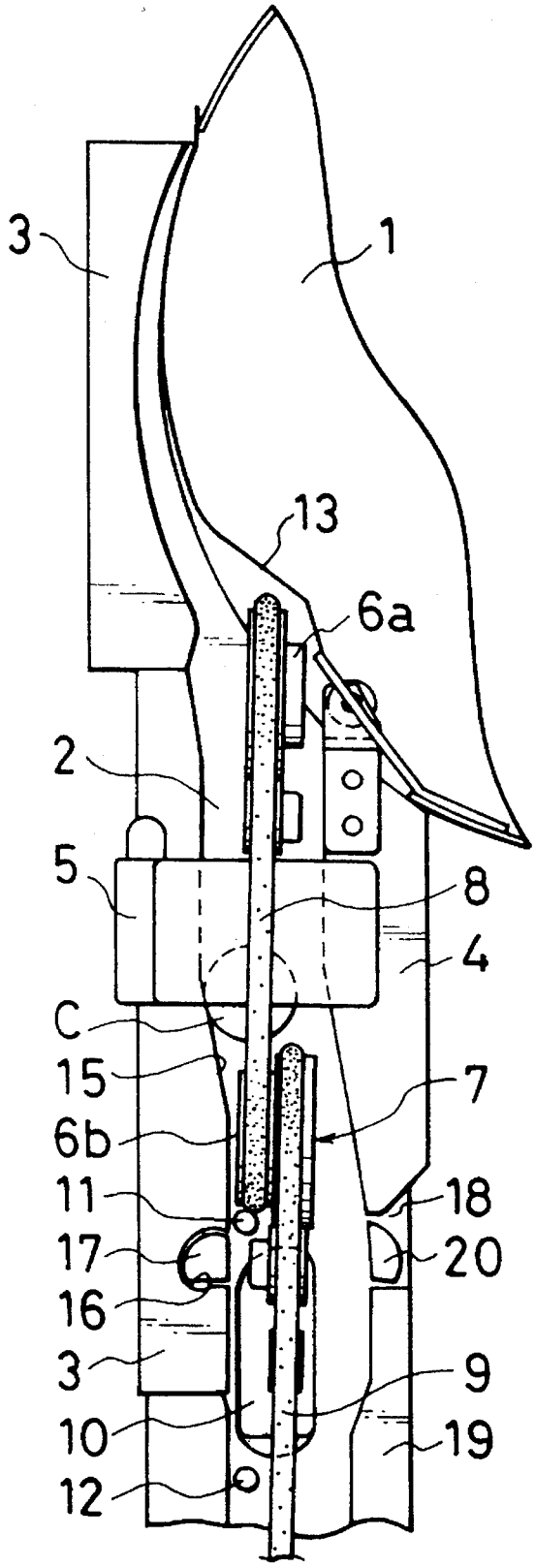
FIG. 1 is a schematic perspective view of an unacceptable coin removing apparatus for a coin handling machine which is an embodiment of the present invention.
Figure 2:
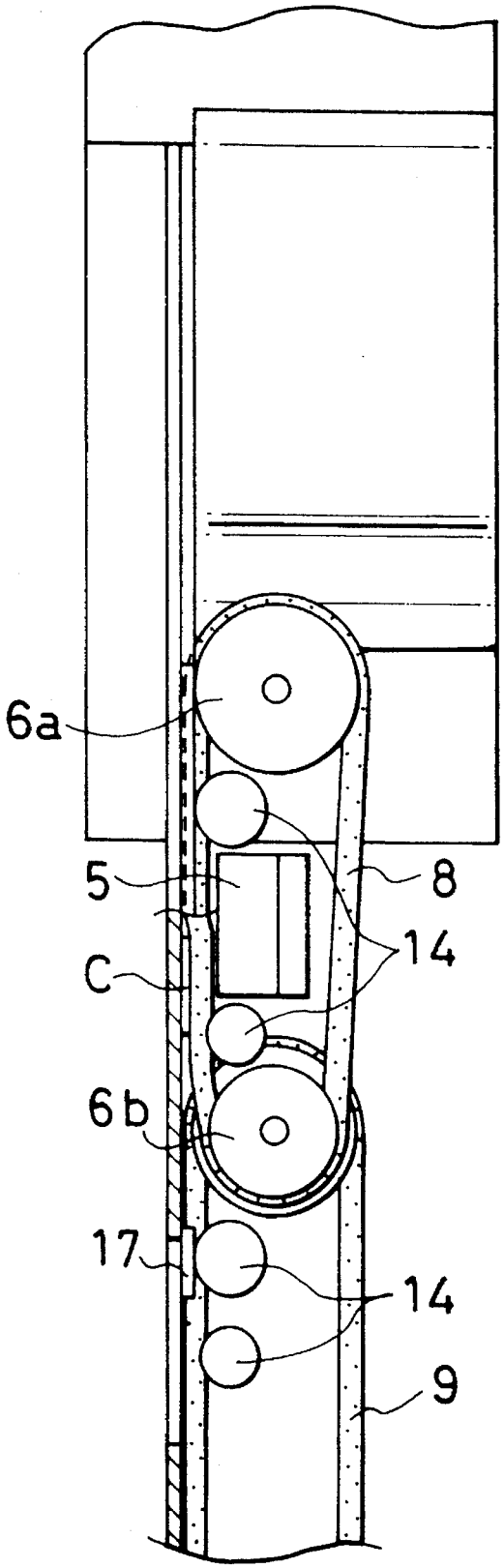
FIG. 2 is a schematic drawing showing a left side view of FIG. 1.

As shown in FIGS. 1 and 2, an unacceptable coin removing apparatus which is an embodiment of the present invention is provided in a coin passage 2 connected to a rotatable disk 1 for receiving coins C deposited into a coin handling machine via a coin transporting means (not shown) by the surface thereof. The coin passage 2 is provided with a reference guide rail 3 for guiding coins C by an inner wall on the side of the coin passage 2 and a guide rail 4 located to face the reference guide rail 3, and a sensor 5 is provided in the vicinity of a portion where the coin passage 2 is connected to the rotatable disk 1 for optically detecting the diameter of each coin C and magnetically detecting material of each coin C.

Further, the coin passage 2 is provided with a first transporting belt 8 wound around pulleys *6a* and *6b* for holding coins C between itself and a surface of the coin passage 2 and transporting them and a second transporting belt 9 wound around a pulley 7 and another pulley (not shown) for holding coins C between itself and a surface of the coin passage 2 and transporting them at a higher speed than the first transporting belt 8. The coin passage 2 below the second transporting belt 9 is formed with an unacceptable coin collecting opening 10 through which foreign articles erroneously deposited into the coin handling machine can fall. A sensor 11 is provided immediately upstream of the unacceptable coin collecting opening 10 in the coin passage 2 for detecting passage of coins C and a sensor 12 is provided immediately downstream of the unacceptable coin collecting opening 10 in the coin passage for counting coins C passing thereon. The pulley *6b* around which the first transporting belt 8 is wound and the pulley 7 around which the second transporting belt 9 is wound are formed integrally and the diameter of the pulley *6b* is smaller than that of the pulley 7 so that the drive speed of the second transporting belt 9 is greater than that of the first transporting belt 8 and the transporting speed of coins C is accelerated by the second transporting belt 9 to increase the distance between coins C successively transported, thereby ensuring that acceptable coins C, unacceptable coins C and foreign articles can be reliably handled.

In FIG. 1, the reference numeral 13 designates a gap setting member for setting the width of a gap between itself and the surface of the rotatable disk 1 in accordance with the thickness of coins to be handled so as to prevent two or more coins C from being simultaneously fed out from the rotatable disk 1 into the coin passage 2 and the reference numeral 14 in FIG. 2 designates press rollers for pressing the first transporting belt 8 and the second transporting belt 9 onto the surface of the coin passage 2.

Figure 3:
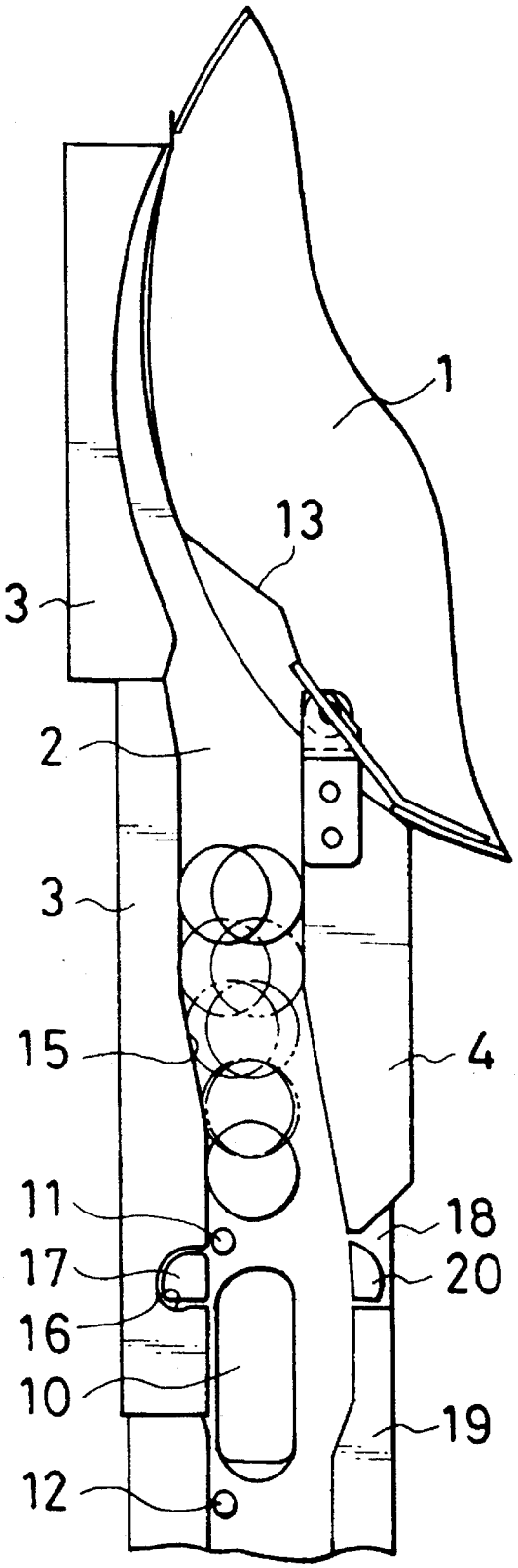
FIG. 3 is a schematic drawing showing a plan view of an unacceptable coin removing apparatus from which a first transporting belt and a second transporting belt are removed.

FIG. 3 is a schematic drawing showing a plan view of an unacceptable coin removing apparatus from which the first transporting belt and the second transporting belt have been removed.

As shown in FIG. 3, the reference guide rail 3 has an oblique wall portion 15 whose side surface is inclined with respect to the longitudinal direction of the first transporting belt 8 so that coins C can be reliably guided along an inner wall of the reference guide rail 3 on the side of the coin passage 2. The guide rail 4 has also an oblique wall portion whose side surface is inclined with respect to the longitudinal direction of the first transporting belt 8 so that the distance between itself and the reference guide rail 3 is constant.

A portion of the reference guide rail 3 corresponding to an upstream portion of the unacceptable coin collecting opening 10 immediately downstream of the sensor 11 is formed with a cut portion 16 in which a first projecting member 17 having a quarter circle cross section is provided. Further, the guide rail 4 terminates at a portion corresponding to the sensor 11 and a guide rail 19 is provided in a downstream portion of the coin passage 2 so that the side surface thereof on the side of the coin passage 2 is flush with the side surface of the guide rail 4 on the side of the coin passage 2 via a gap 18. A second projecting member 20 having an arcuate side surface and a flat side surface is provided in the gap 18 between the guide rail 4 and the guide rail 19 so as to form a pair with the first projecting member 17.

The first projecting member 17 can be rotated within 90 degrees by a first solenoid (not shown) between its retracted position shown in FIG. 1 where the flat side surface thereof is flush with the inner wall of the reference guide rail 3 and its projected position where the circular wall surface projects into the coin passage 2. The second projecting member 20 can be rotated within 90 degrees by a second solenoid (not shown) between its retracted position shown in FIG. 1 where the flat side surface thereof is flush with the inner wall of the guide rail 4 and its projected position where the arcuate side surface thereof projects into the coin passage 2.

Figure 4:
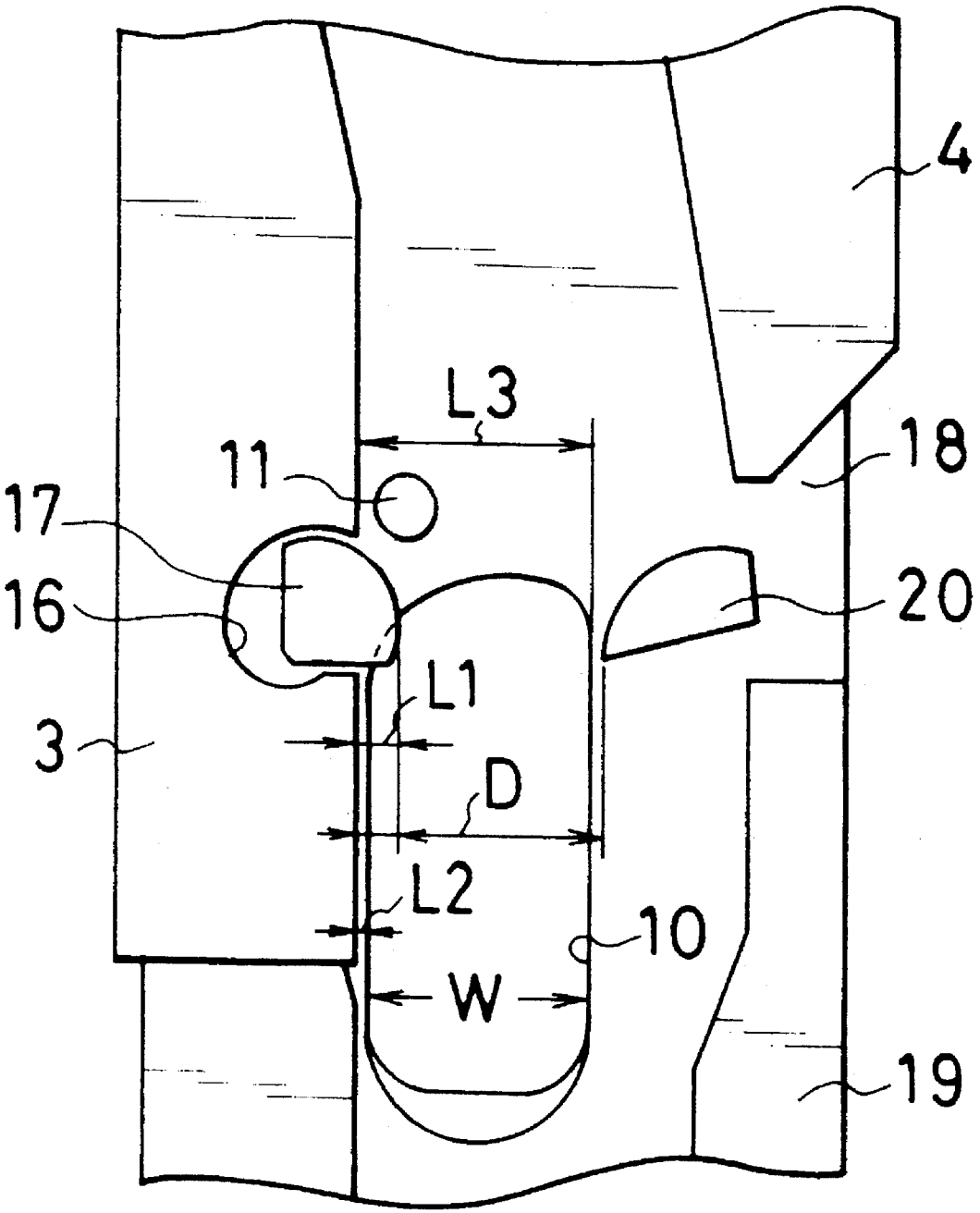
FIG. 4 is a schematic plan view showing a positional relationship between a reference guide rail, a guide rail, an unacceptable coin collecting opening, a cut portion, a gap, a first projecting member and a second projecting member which are located in their projected positions.

FIG. 4 is a schematic plan view showing the positional relationship between the reference guide rail 3, the guide rail 4, the unacceptable coin collecting opening 10, the cut portion 16, the gap 18, and the first projecting member 17 and the second projecting member 20 located in their projected position.

In FIG. 4, distance D between a tip end portion of the first projecting member 17 located at its projected position and a tip end portion of the second projecting member 20 located at its projected position is set to be smaller than the diameter of the smallest coins to be handled and distance L1 between the tip end portion of the first projecting member 17 located at its projected position and the inner wall of the reference guide rail 3 is set to be greater than distance L2 between the inner wall of the reference guide rail 3 and the edge portion of the unacceptable coin collecting opening 10 on the side of the reference guide rail 3. Further, distance L3 between the inner wall of the reference guide rail 3 and the edge portion of the unacceptable coin collecting opening 10 on the side of the guide rail 4 is set to be slightly smaller than the diameter of the smallest coins to be handled and width W of the unacceptable coin collecting opening 10 in the direction perpendicular to the coin transporting direction is set to be greater than the half the diameter of the largest coins to be handled by a predetermined value.

Figure 5:
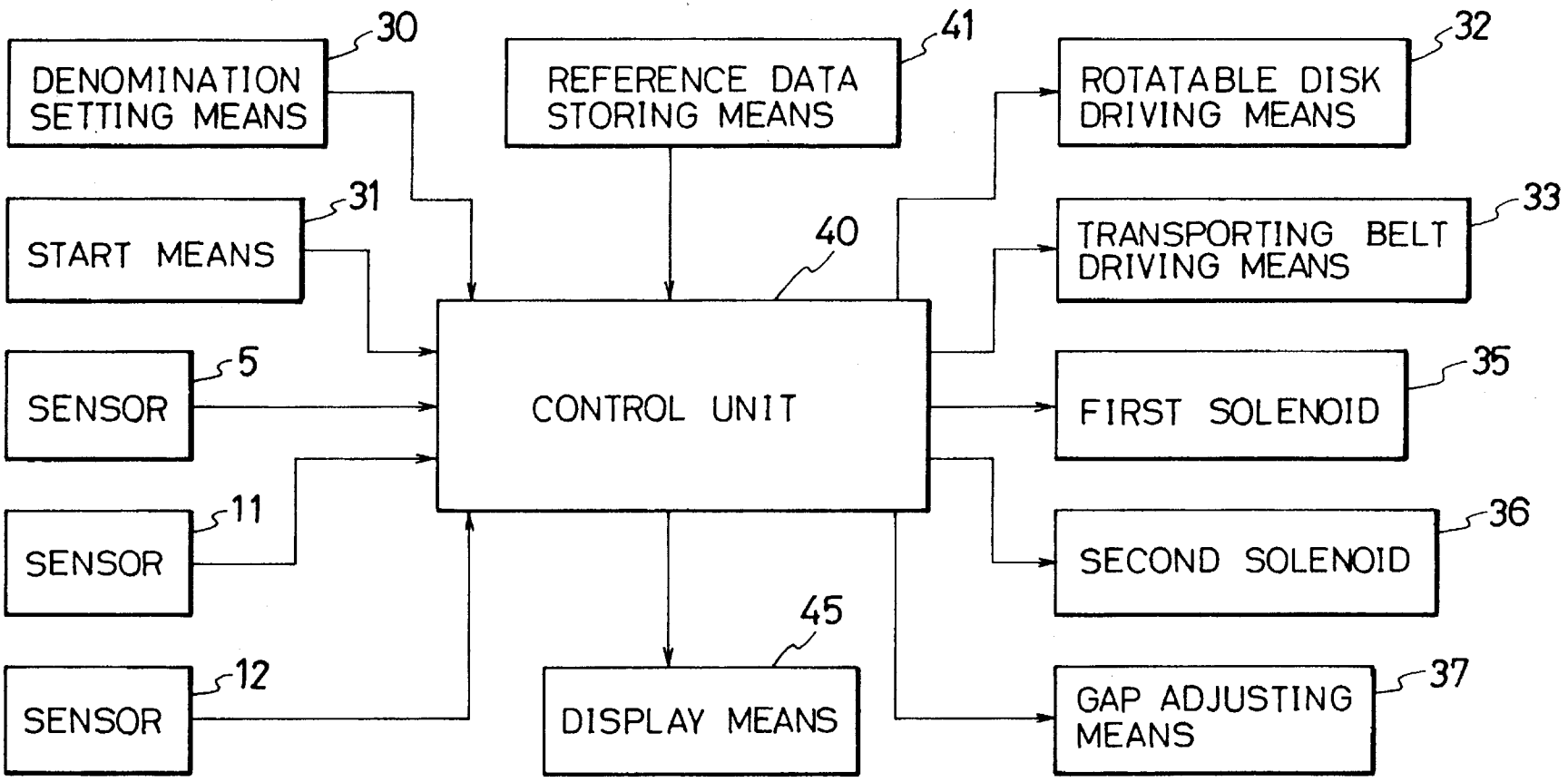
FIG. 5 is a block diagram showing an input system, a detection system, a drive system, a control system and an output system of a coin handling machine provided with an unacceptable coin removing apparatus which is an embodiment of the present invention.

FIG. 5 is a block diagram showing an input system, a detection system, a drive system, a control system and an output system of a coin handling machine provided with an unacceptable coin removing apparatus which is an embodiment of the present invention.

In FIG. 5, the input system of the coin handling machine includes denomination setting means 30 by which the denomination of coins to be handled is input and start means 31 for starting the handling of coins and the detection system includes the sensor 5 for optically detecting the diameters of coins C and magnetically detecting the material of the coins, the sensor 11 for detecting passage of coins C and the sensor 12 for counting the number of coins passing. The drive system of the coin handling machine includes rotatable disk driving means 32, transporting belt driving means 33 for driving the first transporting belt 8 and the second transporting belt 9, a first solenoid 35 for rotating the first projecting member 17 between its retracted position and its projected position, a second solenoid 36 for rotating the second projecting member 20 between its retracted position and its projected position and gap adjusting means 37 for moving the gap setting member 13 vertically and adjusting the gap between the gap setting member 13 and the surface of the rotatable disk 1. Further, the control system of the coin handling machine includes a control unit 40 and reference data storing means 41 for storing reference data relating to the diameters of coins C to be handled and reference data relating to the magnetic properties of coins C. The control unit 40 is constituted so as to read the reference data of a specific denomination from the reference data storing means 41 based on a denomination setting signal input from the denomination setting means 30 and compare the detection data and the reference data in response to a detection signal input from the sensor 5, thereby discriminating whether or not the coin C is acceptable, and a drive signal or a reverse drive signal is output to the first solenoid 35 and/or the second solenoid 36 in accordance with the result of discrimination. Further, the control unit 40 is constituted so as to output a gap adjusting signal to the gap adjusting means 37 based on the denomination setting signal input from the denomination setting means 30, thereby moving the gap setting member 13 vertically and adjusting the gap between the gap setting member 13 and the surface of the rotatable disk 1 in accordance with the denomination of coins C to be handled and output, in response to a start signal or the result of discrimination, a drive signal, a stop signal or a reverse drive signal to the rotatable disk driving means 32 and a drive signal, a stop signal or a reverse drive signal to the transporting belt driving means 33. Moreover, the output system of the coin handling machine includes display means 45 for displaying the results of the coin handling and the control unit 40 outputs a display signal to the display means 45 as occasion demands, thereby causing the display means 45 to display the results of the coin handling.

The thus constituted unacceptable coin removing apparatus for the coin handling machine detects unacceptable coins C and foreign articles erroneously deposited into the coin handling machine and drops them through the unacceptable coin collecting opening 10, thereby removing them. These operation are achieved as follows.

When handling of coins C is started, an operator operates the denomination setting means 30 for setting the denomination of coins to be handled and then operates the start means 31.

The start means 31 outputs a start signal to the control unit 40 and the control unit 40 outputs a drive signal to the rotatable disk driving means 32 so as to rotate the rotatable disk 1 and also outputs a drive signal to the transporting belt driving means 33 so as to drive the first transporting belt 8 and the second transporting belt 9.

The denomination setting means 30 outputs a denomination setting signal to the control unit 40 and the control unit 40 outputs a gap adjusting signal to the gap adjusting means 37 based on the thus input denomination setting signal, thereby moving the gap setting member 13 vertically so that the gap between the gap setting member 13 and the surface of the rotatable disk 1 is greater than the thickness of coins C to be handled and less than twice the thickness and reads the reference data relating to the diameter and magnetic property of coins C determined by the denomination setting means 30 and to be handled.

On the other hand, coins C deposited through a coin depositing section (not shown) into the coin handling machine are fed by coin transporting means (not shown) onto the rotatable disk 1 and are further fed into the coin passage 2 by the centrifugal force produced by the rotation of the rotatable disk 1. At this time, since the vertical position of the gap setting member 13 is adjusted so that the gap between itself and the surface of the rotatable disk 1 is greater than the thickness of coins C to be handled and less than twice the thickness, the coins C are fed into the coin passage 2 one by one and double feed of coins can be avoided.

The sensor 5 detects the diameter and magnetic property of each coin C fed into the coin passage 2 and outputs a detection signal to the control unit 40. In response to the detection signal input from the sensor 5, the control unit 40 compares the detected data relating to the diameter of the coin C and detected data relating to the magnetic property with the reference data read out from the reference data storing means 41.

As a result, when the detected data relating to the diameter of a coin C coincide with the corresponding reference data and the detected data relating to the magnetic property of the coin C coincide with the corresponding reference data, the control unit 40 judges that the coin C is the coin C set by the denomination setting means 30 and increments the coin C count stored in memory without outputting any signal.

Figure 6:
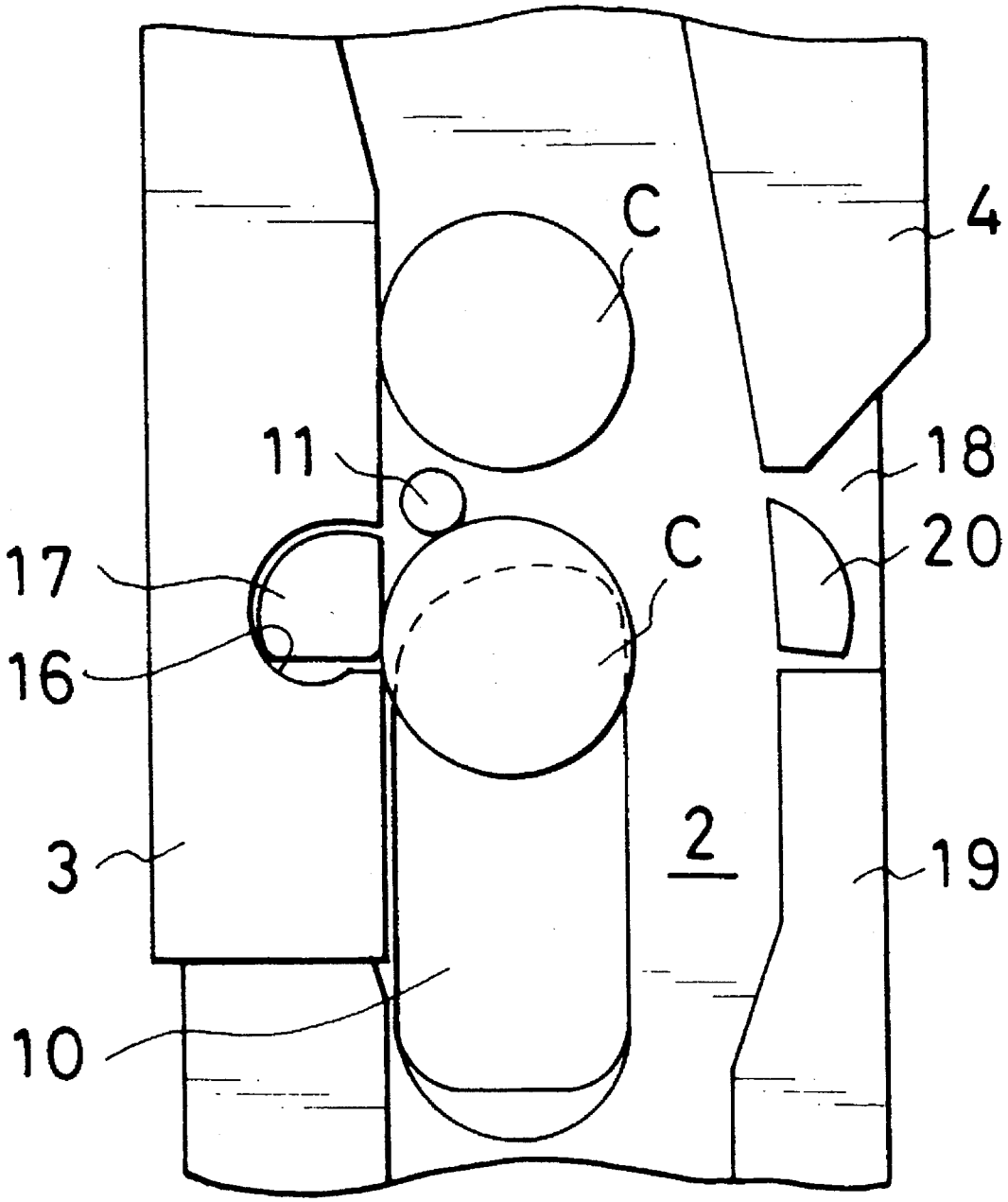
FIG. 6 is a schematic plan view showing the positional relationship between a first projecting member, a second projecting member and an unacceptable coin collecting opening when an unacceptable coin is detected.

Therefore, the first projecting member 17 and the second projecting member 20 are held at their retracted positions and, as shown in FIG. 6, the coin C is moved along the inner wall of the reference guide rail 3 by the oblique wall portion 15 of the reference guide rail 3 and passes by the sensor 11 and the unacceptable coin collecting opening 10, while being guided by the inner wall of the reference guide rail 3. Then, the coin is counted by the sensor 12 and further fed downstream in the coin passage 2.

On the contrary, when the detected data relating to the diameter of the coin C do not coincide with the corresponding reference data and the detected data relating to magnetic property do not coincide with the corresponding reference data, since it can be considered that the coin C is an unacceptable coin such as a counterfeit coin, a foreign coin, or a foreign article such as a washer or the like erroneously deposited into the coin handling machine, the control unit 40 judges that it should be removed and further judges whether or not the diameter of the coin C or the foreign article is greater than the diameter of the reference data.

Figure 7:
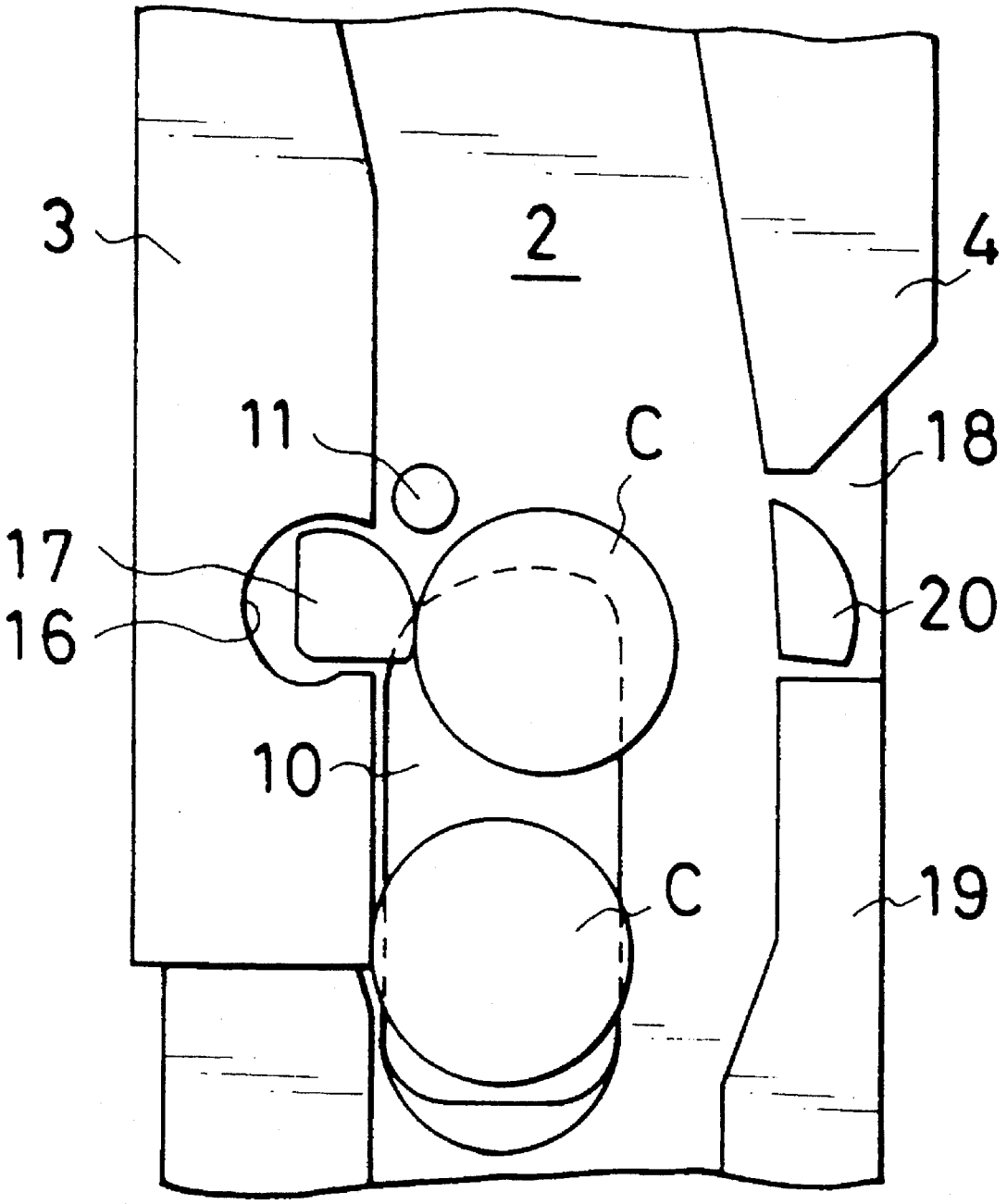
FIG. 7 is a schematic plan view showing a positional relationship between a first projecting member, a second projecting member and an unacceptable coin collecting opening when an unacceptable coin having a diameter greater than a predetermined one or a foreign article is detected.

When the control unit 40 judges that the diameter of the coin C or the foreign article is greater than the diameter of the reference data, the control unit 40 outputs a drive signal to the first solenoid 35 at the time it receives a detection signal regarding the coin C from the sensor 11 so as to rotate the first projecting member 17 from its retracted position to its projected position where the tip end portion thereof projects into the coin passage 2. The coin C or the foreign article having a greater diameter than that of the reference data is moved by the oblique wall portion 15 of the reference guide rail 3 along the inner wall of the reference guide rail 3 and is transported in the coin passage 2, while being guided by the inner wall of the reference guide rail 3. Therefore, as shown in FIG. 7, the coin C or the foreign article to be removed collides with the circular wall of the first projecting member 17 and is pushed toward the guide rail 4, whereby it is not guided by the inner wall of the reference guide rail 3 and is further fed downstream in the coin passage 2. Since the width W of the unacceptable coin collecting opening 10 in the direction perpendicular to the coin transportation direction is determined to be greater than half the diameter of the largest coins to be handled by a predetermined value, the edge portion of the coin C or the foreign article is not supported by the coin passage 2 and an area thereof greater than half its whole area is not supported by the coin passage 2. Accordingly, the coin C or the foreign article drops into the unacceptable coin collecting opening 10 to be removed into a collecting box (not shown).

Figure 8:
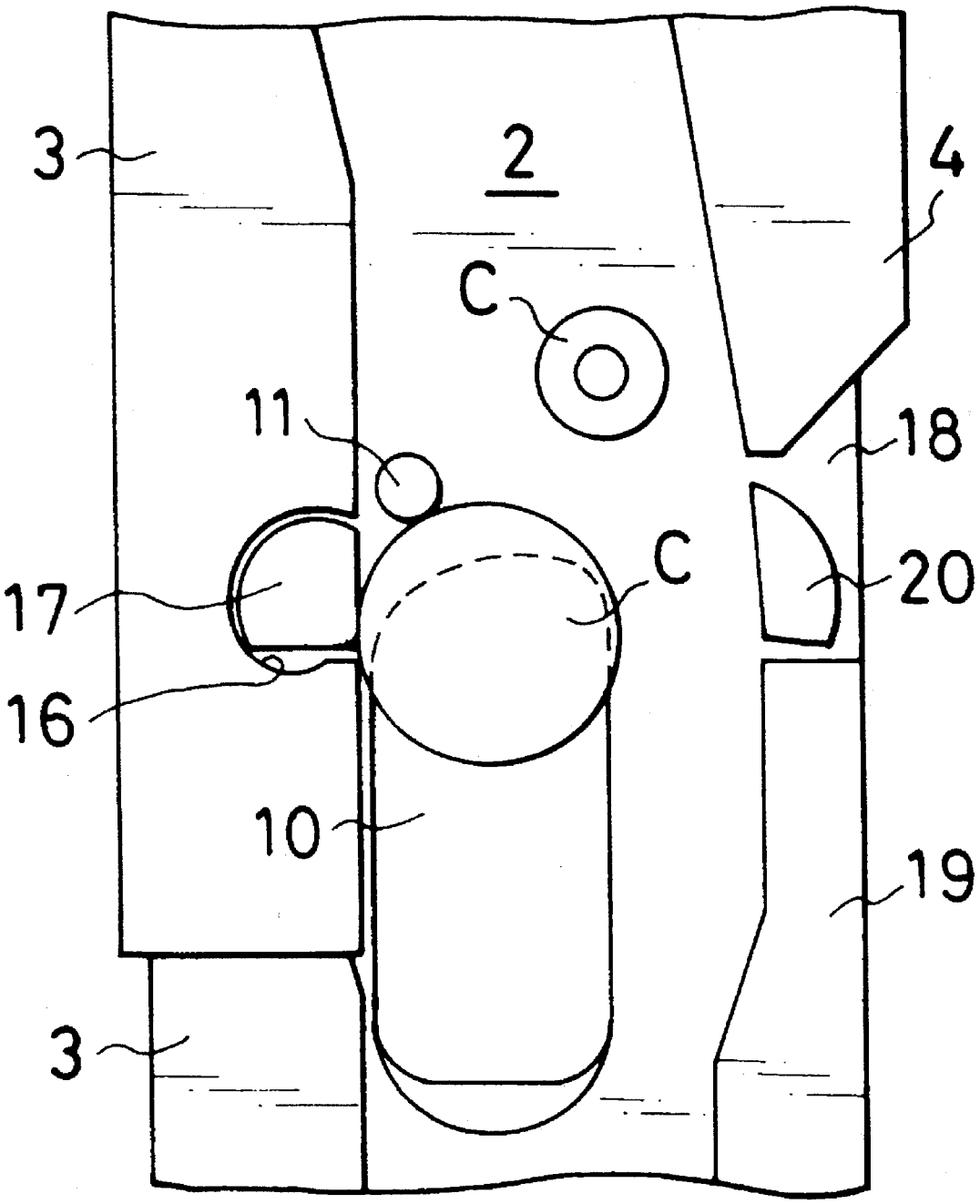
FIG. 8 is a schematic plan view showing the positional relationship between an unacceptable coin or a foreign article, a first projecting member, a second projecting member and an unacceptable coin collecting opening when an unacceptable coin having a diameter smaller than a predetermined one or a foreign article is detected.
Figure 9:
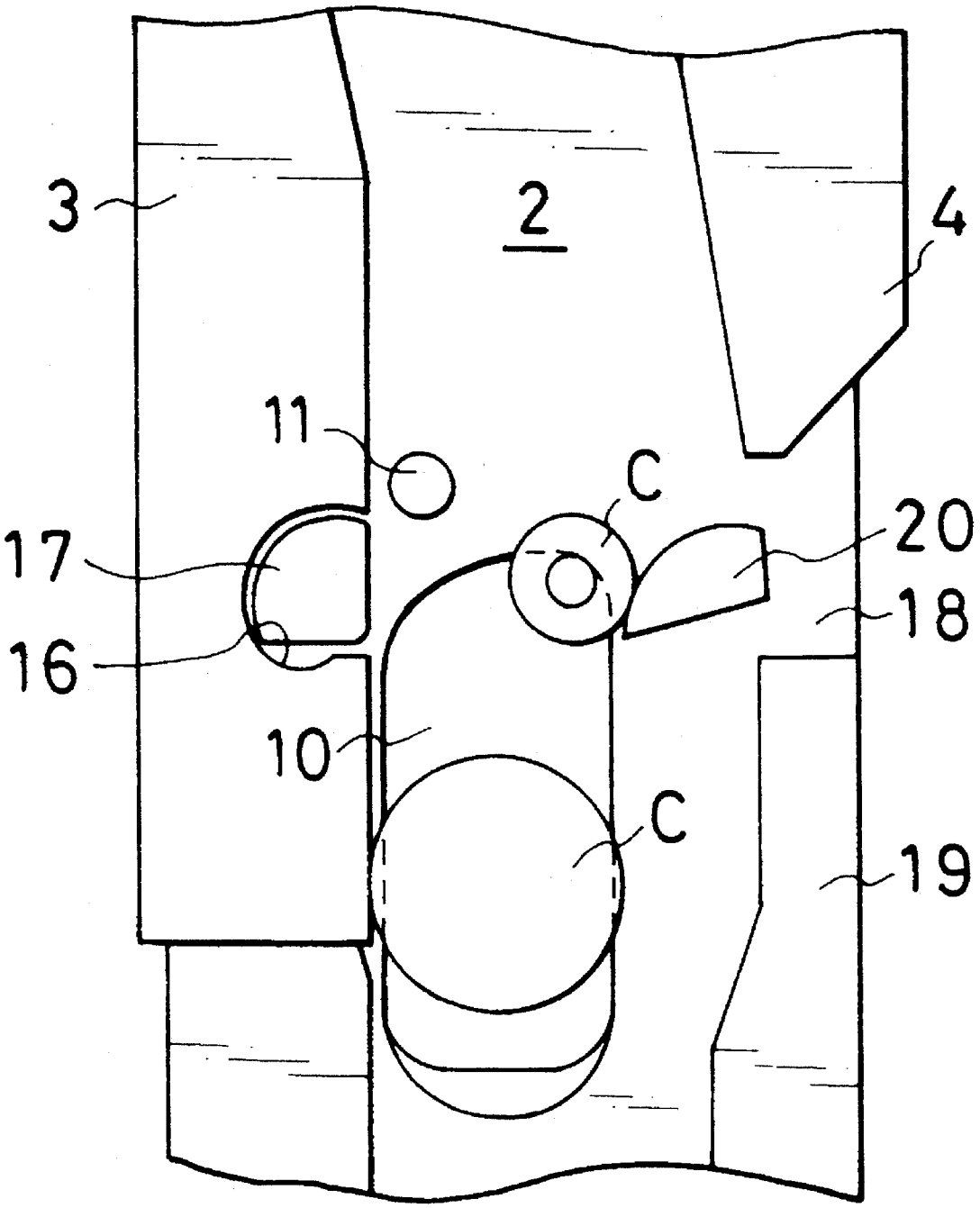
FIG. 9 is a schematic plan view showing the positional relationship between a first projecting member, a second projecting member and an unacceptable coin collecting opening when an unacceptable coin having a smaller diameter than a predetermined one or a foreign article is detected.

On the other hand, when the control unit 40 judges that the diameter of the coin C or the foreign article is smaller than the diameter of the reference data, it outputs a drive signal to the second solenoid 36 so as to rotate the second projecting member 20 from its retracted position to its projected position where the tip end thereof projects into the coin passage 2. In the case where the diameter of the coin C or the foreign article is smaller than the diameter of the reference data, the coin C or the foreign article may not be guided by the inner wall of the reference guide rail 3 but, as shown in FIG. 8, may be transported at the central portion of the coin passage 2, while being held between coins C. Therefore, since there is some possibility of the unacceptable coin C or the foreign article not passing over the sensor 11, the control unit 40 responds to a detection signal from the sensor 5 by rotating the second projecting member 20 instead of the first projecting member 17 when a predetermined time has passed after the sensor 11 detected the coin C preceding the unacceptable coin C or the foreign article, thereby projecting the second projecting member 20 into the coin passage 2. As a result, as shown in FIG. 9, the coin C or the foreign article collides with the arcuate side surface of the second projecting member 20 and is fed toward the unacceptable coin collecting opening 10, whereby it drops into the unacceptable coin collecting opening 10 and is removed into the collecting box (not shown). In the case where the coin C or the foreign article having a smaller diameter than that of the reference data is fed along the inner wall of the reference guide rail 3, it drops into the unacceptable coin collecting opening 10 without colliding with the arc side surface of the second projecting member 20 and is collected in the collecting box.

Figure 10:
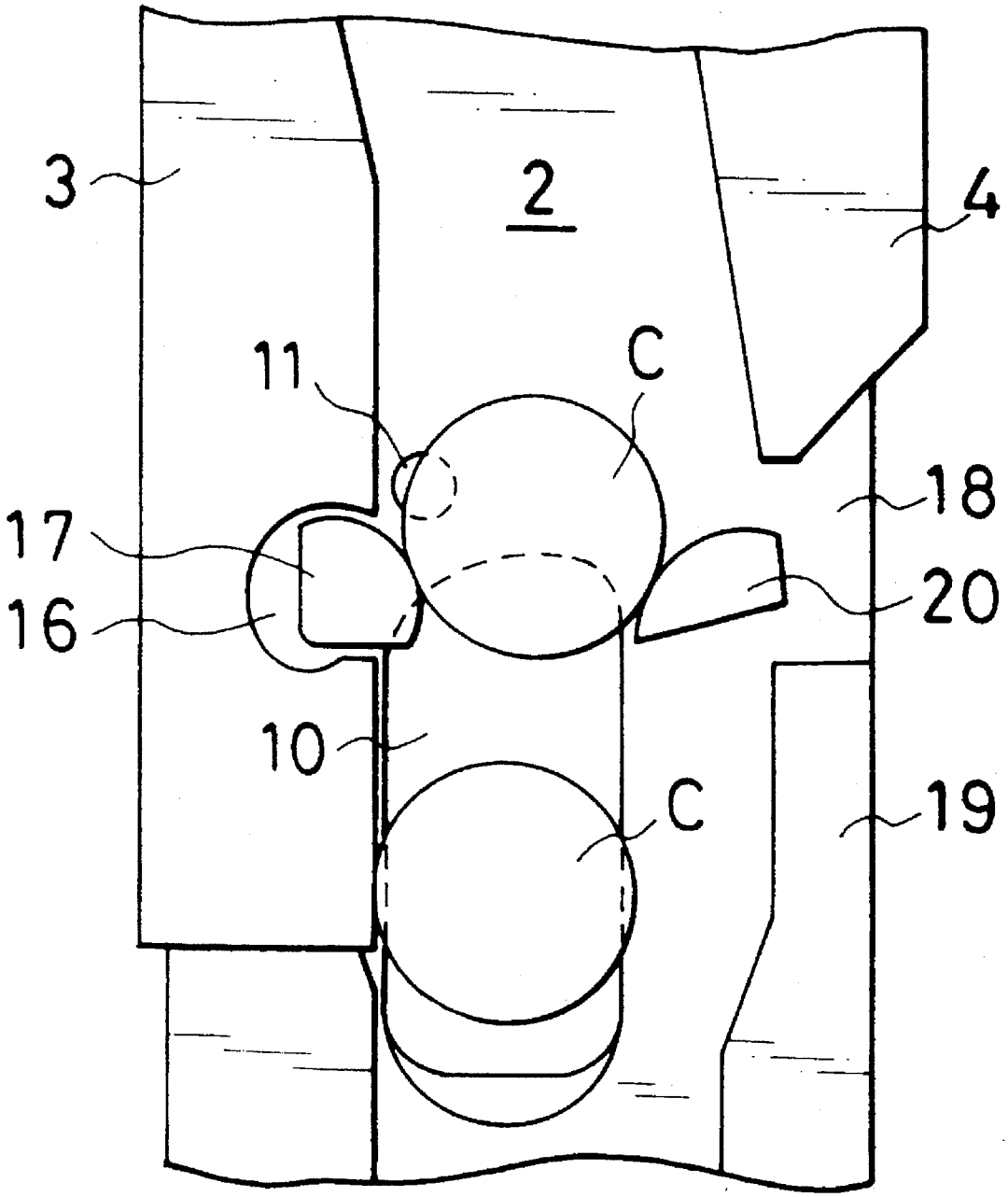
FIG. 10 is a schematic plan view showing the positional relationship between a first projecting member, a second projecting member and an unacceptable coin collecting opening when a coin which cannot definitely be discriminated as acceptable is detected.

On the contrary, when the detected data relating to the diameter of a coin C coincide with the corresponding reference data but the detected data relating to the magnetic property do not coincide with the corresponding reference data or when the detected data relating to the magnetic property coincide with the corresponding reference data but the detected data relating to the diameter of a coin C do not coincide with the corresponding reference data, there is a possibility that accurate detection was not made due to dust or the like adhering to the sensor 5. In such case, if the coin C is discriminated as unacceptable when it is actually acceptable, the efficiency of the coin handling machine is lowered. On the other hand, if the coin C is considered acceptable when it is actually unacceptable, unacceptable coins cannot be reliably removed. Therefore, according to this embodiment, in this case, it is judged that the reliability of discrimination made by the sensor 5 is low and that it is necessary for the sensor 5 to conduct another discrimination. The control unit 40 therefore outputs drive signals to the first solenoid 35 and the second solenoid 36 so as to rotate the first projecting member 17 and the second projecting member 20 from their retracted positions to their projected positions. Since the distance D between the tip end portion of the first projecting member 17 and the tip end portion of the second projecting member 20 is determined to be smaller than the diameter of the smallest coins C to be handled, as shown in FIG. 10, the coin C is stopped by the first projecting member 17 and the second projecting member 20. Simultaneously, the control unit 40 outputs a stop signal to the transporting belt driving means 33 so as to stop the first transporting belt 8 and the second transporting belt 9 and also outputs a stop signal to the rotatable disk driving means 32 so as to stop the rotatable disk 1. Then, the control unit 40 outputs a reverse drive signal to the transporting belt driving means 33 so as to reversely drive the first transporting belt 8 and the second transporting belt 9 and also outputs a reverse drive signal to the rotatable disk driving means 32 to reversely rotate the rotatable disk 1, thereby returning the coin C stopped by the first projecting member 17 and the second projecting member 20 onto the rotatable disk 1. Afterwards, the control unit 40 outputs stop signals to the rotatable disk driving means 32 and the transporting belt driving means 33 and further outputs drive signals to them, thereby feeding the coin C on the rotatable disk 1 into the coin passage 2 again. The sensor 5 detects the diameter and the magnetic property of the coin C fed into the coin passage 2 and the coin C is fed downstream in the coin passage 2 or drops into the unacceptable coin collecting opening 10 to be removed or returned onto the rotatable disk 1 similarly to the above. Thus, after the sensor 5 has detected the diameter and magnetic property of the coin C, if the detected data relating to the diameter of a coin C coincide with the corresponding reference data but the detected data relating to the magnetic property do not coincide with the corresponding reference data or if the detected data relating to the magnetic property coincide with the corresponding reference data but the detected data relating to the diameter of a coin C do not coincide with the corresponding reference data, the coin C is returned onto the rotatable disk 1. However, since dust adhering to the sensor 5 or the like is often removed by the passing of the coin C, the second detection of the same coin C by the sensor normally finds the detected data relating to the diameter of the coin C coincide with the corresponding reference data and that the detected data relating to the magnetic property coincide with the corresponding reference data. It is therefore rare for a coin to be returned onto the rotatable disk 1 three times or more.

According to this embodiment, coins C discriminated as unacceptable and foreign articles such as washers or the like can be dropped into the unacceptable coin collecting opening 10 and be removed without stopping the transport of coins C and another discrimination is conducted with respect to any coin C which could not be discriminated as acceptable based on the data detected by the sensor 5 since the detected data relating to the diameter of the coin C did not coincide with the corresponding reference data or the detected data relating to the magnetic property did not coincide with the corresponding reference data, and its acceptability is again determined by having the sensor 5 detect its diameter and magnetic property. Therefore, on the one hand, since such a coin C is not discriminated as unacceptable, it is possible to prevent the efficiency of the coin handling machine from being lowered and, on the other hand, since such a coin is not immediately discriminated as acceptable, the accuracy of removing unacceptable coins can be prevented from being lowered.

Figure 11:
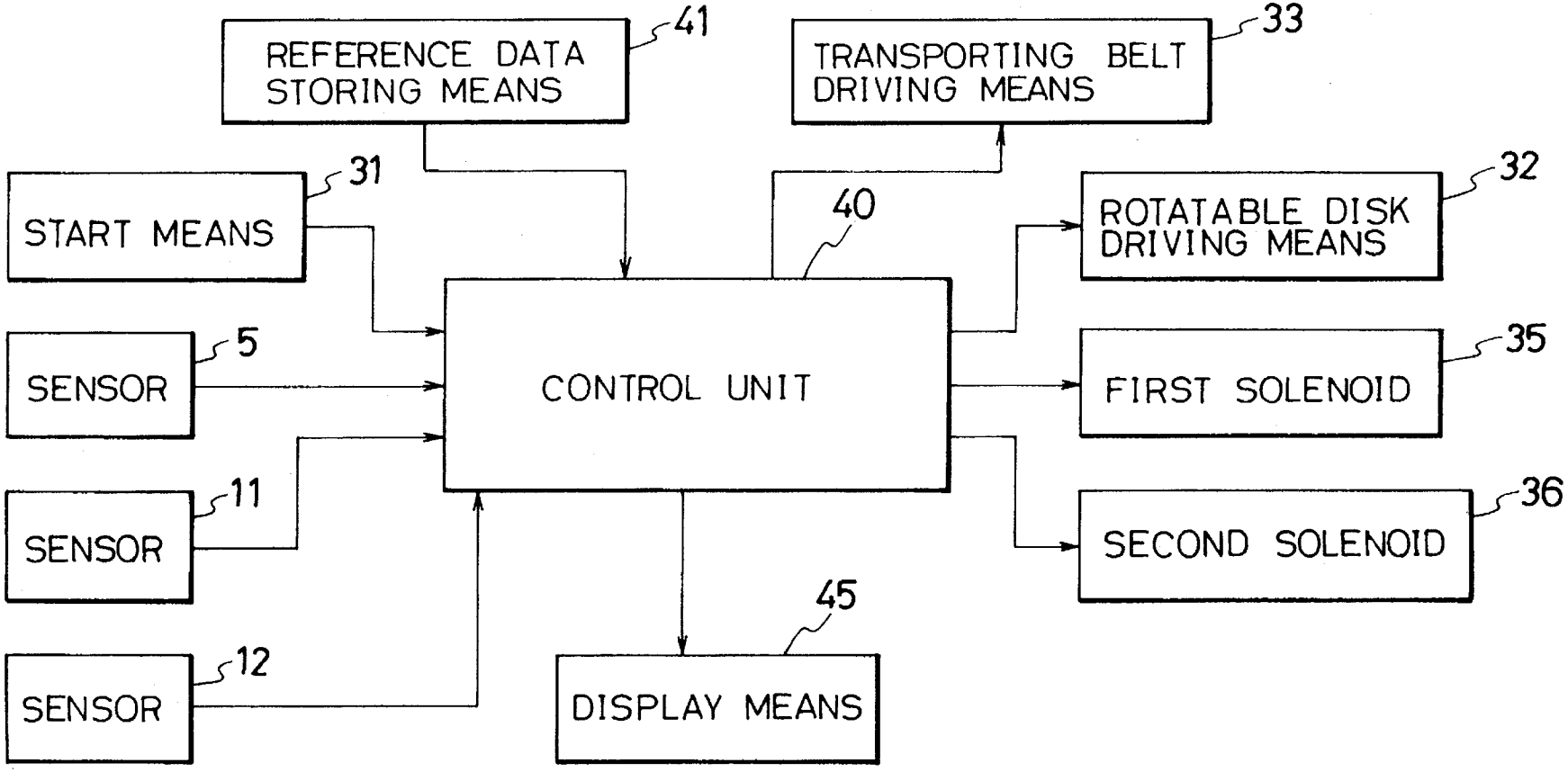
FIG. 11 is a block diagram of an input system, a detection system, a drive system, a control system and an output system of a coin handling machine provided with an unacceptable coin removing apparatus which is another embodiment of the present invention.

FIG. 11 is a block diagram of an input system, a detection system, a drive system, a control system and an output system of a coin handling machine provided with an unacceptable coin removing apparatus which is another embodiment of the present invention. The unacceptable coin removing apparatus in this embodiment is provided for use in a coin handling machine which does not handle coins of a specified denomination but handles coins in accordance with their denominations.

In FIG. 11, the input system of the coin handling machine includes start means 31 for causing the handling of coins C to be started and the detection system thereof includes a sensor 5 for optically detecting the diameters of coins C and magnetically detecting the material of coins C, a sensor 11 for detecting coin passage and a sensor 12 for counting the number of coins which have passed. Further, the drive system of the coin handling machine includes rotatable disk driving means 32 for rotating or stopping the rotatable disk 1, transporting belt driving means 33 for driving the first transporting belt 8 and the second transporting belt 9, a first solenoid 35 for rotating the first projecting member 17 between its retracted position and its projected position and a second solenoid 36 for rotating the second projecting member 20 between its retracted position and its projected position. The control system of the coin handling machine includes a control unit 40 and reference data storing means 41 for storing reference data relating to the diameters of coins C to be handled and reference data relating to the magnetic properties of the coins C to be handled and the reference data storing means 41 stores reference data relating to the diameters and reference data relating to the magnetic properties of all denominations of coins C to be handled. The control unit 40 judges whether or not reference data which coincide with detected data relating to a diameter input from the sensor 5 are stored in the reference data storing means 41 and only when reference data coinciding with the detected data relating to the diameter are stored, the control unit 40 reads the reference data relating to the magnetic property of the coin of the denomination having the diameter from the reference data storing means 41 and judges whether or not the coin is acceptable by comparing the detected data relating to the magnetic property with the corresponding reference data. More specifically, contrary to the previous embodiment, since the coin handling machine in this embodiment does not handle only coins of a specified denomination in a predetermined manner but handles coins in a predetermined manner in accordance with the denominations of the coins, if reference data coinciding with detected data relating to a diameter are not stored in the reference data storing means 41, it is impossible to read the reference data relating to the magnetic property from the reference data storing means 41. Therefore, the control unit 40 first, judges whether or not the reference data storing means 41 stores reference data which coincide with detected data relating to the diameter input from the sensor 5. As a result, when the reference data storing means 41 does not store reference data which coincide with detected data relating to the diameter and the detected diameter of a coin is equal to or greater than a first predetermined value smaller than the diameter of the smallest coins stored in the reference data storing means 41 or is equal to or smaller than a second predetermined value greater than the diameter of the largest coins, the control unit 40 judges that it is unclear whether or not the coin is acceptable. 0n the other hand, when the reference data storing means 41 does not store reference data which coincide with detected data relating to the diameter and the detected diameter of a coin is smaller than the first predetermined value smaller than the diameter of the smallest coins stored in the reference data storing means 41 or is greater than the second predetermined value greater than the diameter of the largest coins, the control unit 40 judges that the detected object is not a coin but a foreign article erroneously deposited into the coin handling machine. On the contrary, when the reference data storing means 41 stores reference data which coincide with detected data relating to the diameter, the control unit 40 further reads reference data relating to the magnetic property of the coins of the denomination having the diameter from the reference data storing means 41 and compares the detected data relating to the magnetic property with the corresponding reference data. As a result, when the detected data relating to the magnetic property coincide with the corresponding reference data, the control unit 40 judges that the coin is acceptable, while it judges that the coin is unacceptable when they do not coincide with each other.

The thus constituted unacceptable coin removing apparatus for the coin handling machine detects unacceptable coins C and foreign articles erroneously deposited into the coin handling machine and drop them through the unacceptable coin collecting opening 10, thereby removing them. These operation are achieved as follows.

When the start means 31 is operated by an operator and a start signal is input, the control unit 40 outputs a drive signal to the rotatable disk driving means 32 so as to rotate the rotatable disk 1 and outputs a drive signal to the transporting belt driving means 33 so as to drive the first transporting belt 8 and the second transporting belt 9.

Coins C deposited through a coin depositing section (not shown) into the coin handling machine are fed by coin transporting means (not shown) onto the rotatable disk 1 and are further fed into the coin passage 2 by the centrifugal force produced by the rotation of the rotatable disk 1. At this time, since the vertical position of the gap setting member 13 is adjusted so that the gap between itself and the surface of the rotatable disk 1 is greater than the thickness of coins C to be handled and less than twice the thickness, coins C are fed into the coin passage 2 one by one and double feed of coins can be avoided.

The sensor 5 detects the diameter and the magnetic property of each coin C fed into the coin passage 2 and outputs a detection signal to the control unit 40. Based on the detection signal relating to the diameter of the coin C input from the sensor 5, the control unit 40 judges whether or not reference data which coincide with the detected data relating to the diameter of the coin C are stored in the reference data storing means 41.

As a result, when the control unit 40 judges that the reference data which coincide with the detected data relating to the diameter of the coin C are stored in the reference data storing means 41, it further reads reference data relating to the magnetic property of the coins C having the same diameter as that of the coin C from the reference data storing means 41 and compares the detected data relating to the magnetic property of the coin C with the corresponding reference data. When the detected data relating to the magnetic property of the coin C coincide with the corresponding reference data, the control unit 40 judges that the coin C is acceptable and increments the coin C stored in memory without outputting any signal.

Therefore, the first projecting member 17 and the second projecting member 20 are held at their retracted positions and, as shown in FIG. 6, the coin C is moved along the inner wall of the reference guide rail 3 by the oblique wall portion 15 of the reference guide rail 3 and passes by the sensor 11 and the unacceptable coin collecting opening 10, while being guided by the inner wall of the reference guide rail 3. Then, coin is counted by the sensor 12 and further fed downstream in the coin passage 2.

On the contrary, when the reference data which coincide with the detected data relating to the diameter of the coin C are not stored in the reference data storing means 41 and the detected diameter of the coin C is smaller than a first predetermined value smaller than the diameter of the smallest coins C stored in the reference data storing means 41 or is greater than a second predetermined value greater than the diameter of the largest coins C, it can be considered that the detected object is a foreign article such as a washer or the like erroneously deposited into the coin handling machine. Therefore, the control unit 40 judges that it should be removed.

When the control unit 40 judges that the diameter of the detected object is smaller than the first predetermined value smaller than the diameter of the smallest coins C stored in the reference data storing means 41, it outputs a drive signal to the second solenoid 36 so as to rotate the second projecting member 20 from its retracted position to its projected position where the tip end thereof projects into the coin passage 2. Where the diameter of the foreign article is smaller than that of the reference data, the foreign article may not be guided by the inner wall of the reference guide rail 3 but, as shown in FIG. 8, is usually transported at the central portion of the coin passage 2 while being held between coins C. Accordingly, since there is some possibility of the foreign article not passing over the sensor 11, the control unit 40 rotates, responds to a detection signal from the sensor 5 by rotating the second projecting member 20 instead, of the first projecting member 17 when a predetermined time has passed after the sensor 11 detected a coin C preceding the foreign article, thereby projecting the second projecting member 20 into the coin passage 2. As a result, as shown in FIG. 9, the foreign article collides with the arcuate side surface of the second projecting member 20 and is fed toward the unacceptable coin collecting opening 10, whereby it drops into the unacceptable coin collecting opening 10 and is removed into the collecting box (not shown).

On the contrary, when the control unit 40 judges that the diameter of the foreign article is greater than the second predetermined value greater than the diameter of the largest coins stored in the reference data storing means 41, the control unit 40 outputs a drive signal to the first solenoid 35 at the time it receives a detection signal regarding the coin C from the sensor 11 so as to rotate the first projecting member 17 from its retracted position to its projected position where the tip end thereof projects into the coin passage 2. The foreign article having a diameter greater than the second predetermined value is moved along the inner wall of the reference guide rail 3 by the oblique wall portion 15 of the reference guide rail 3 and is fed in the coin passage 2 while being guided by the inner wall of the reference guide rail 3. Therefore, as shown in FIG. 7, the foreign article collides with the circular wall of the first projecting member 17 located at its projected position and is pushed toward the guide rail 4. As a result, the foreign article is fed downstream in the coin passage 2 while not being guided by the inner wall of the reference guide rail 3 and drops into the unacceptable coin collecting opening 10 to be removed into the collecting box.

On the other hand, when reference data which coincide with the detected data relating to the diameter of the coin C are not stored in the reference data storing means 41 and the detected diameter of the coin C is equal to or greater than the first predetermined value smaller than the diameter of the smallest coins C stored in the reference data storing means 41 and is equal to or smaller than the second predetermined value greater than the diameter of the largest coins C, there is some possibility that accurate detection was not made due to dust adhering to the sensor 5 or the like. In such case, if this coin C is removed as an unacceptable coin C when it is actually acceptable, the efficiency of the coin handling machine is lowered. On the other hand, if the coin C is handled as an acceptable coin C when it is actually unacceptable, unacceptable coins cannot be reliably removed. Therefore, similarly to the previous embodiment, the control unit 40 judges that it is necessary to have the sensor 5 conduct another discrimination of the coin and outputs drive signals to the first solenoid 35 and the second solenoid 36 so as to rotate the first projecting member 17 and the second projecting member 20 from their retracted positions to their projected positions. Since the distance D between the tip end portion of the first projecting member 17 located at its projected position and the tip end portion of the second projecting member 20 located at its projected position is determined to be smaller than the diameter of the smallest coins C to be handled, as shown in FIG. 10, this coin C is stopped by the first projecting member 17 and the second projecting member 20. Simultaneously, the control unit 40 outputs a stop signal to the transporting belt driving means 33 so as to stop the first transporting belt 8 and the second transporting belt 9 and also outputs a stop signal to the rotatable disk driving means 32 so as to stop the rotation of the rotatable disk 1. Then, the control unit 40 outputs reverse drive signals to the transporting belt driving means 33 and the rotatable disk driving means 32 so as to reversely drive the first transporting belt 8 and the second transporting belt 9 and to reversely rotate the rotatable disk 1, thereby returning the coin C which was stopped by the first projecting member 17 and the second projecting member 20 onto the rotatable disk 1. Afterwards, the control unit 40 outputs stop signals to the rotatable disk driving means 32 and the transporting belt driving means 33 and then outputs drive signals to them, thereby again feeding the coin C on the rotatable disk 1 into the coin passage 2. The sensor 5 detects the diameter and the magnetic property of the coin C fed out into the coin passage 2 and the coin C is further fed downstream in the coin passage 2 or drops into the unacceptable coin collecting opening 10 to be removed or is returned onto the rotatable disk 1 in the above described manner.

The present invention has thus been shown and described with reference to specific embodiments. However, it should be noted that the present invention is in no way limited to the details of the described arrangements but changes and modifications may be made without departing from the scope of the appended claims.

For example, in the embodiment shown in FIGS. 1 to 10, the denomination setting means 30 to be operated by an operator for specifying the denomination of coins to be handled is provided and the control unit 40 reads reference data regarding the specified denomination from the reference data storing means 41 in accordance with a denomination setting signal input from the denomination setting means 30 and compares the detected data with the reference data in response to a detection signal input from the sensor 5, thereby discriminating whether or not the coin is acceptable. However, it is possible to handle coins in accordance with their denominations without providing the denomination setting means for specifying the denomination of coins to be handled by judging whether or not reference data which respectively coincide with data relating to the diameter and magnetic property detected by the sensor 5 are stored in the reference data storing means 41 and judging whether or not the coin is acceptable.

Further, in the above described embodiments, although the first projecting member 17 or the second projecting member 20 is rotated from its retracted position to its projected position in response to a detection signal from the sensor 11, it is possible to achieve the same result in response to a detection signal from the sensor 5, without using the sensor 11. Specifically, the first projecting member 17 or the second projecting member 20 can be rotated when a predetermined time has passed after a detection signal was input from the sensor 5.

Moreover, in the above described embodiments, although the sensor 12 for counting the number of coins handled is provided in addition to the sensor 5, it is possible to detect the number of coins handled based on detection signals from the sensor 5.

Furthermore, in the above described embodiments, although the second transporting belt 9 driven at higher speed than that of the first transporting belt 9 is provided for increasing the distance between successively fed coins C, the second transporting belt 9 may be driven at the same speed as that of the first transporting belt 8 or the second transporting belt may be omitted.

Further, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide an unacceptable coin removing apparatus for a coin handling machine which can efficiently and reliably remove unacceptable coins.

We claim:

1. An unacceptable coin removing apparatus for a coin handling machine comprising a rotatable disk for receiving coins deposited into the coin handling machine and feeding out coins to a coin passage one by one by a centrifugal force produced by the rotation thereof, a reference guide rail for guiding coins by an inner wall thereof, a facing guide rail provided so as to face the reference guide rail via the coin passage, transporting belt means for transporting coins so as to hold coins between itself and a surface of the coin passage and coin detecting means for detecting coin diameters and coin material, the unacceptable coin removing apparatus for the coin handling machine further comprising first projecting means provided in the coin passage downstream of the coin detecting means and adapted to be projected into the coin passage from the reference guide rail, second projecting means paired with the first projecting means and adapted to be projected into the coin passage from the facing guide rail, unacceptable coin collecting means provided in the coin passage downstream of the first projecting means and the second projecting means and adapted for collecting unacceptable coins and foreign articles, and control means for discriminating whether or not coins are acceptable based on detection data detected by the coin detecting means, the control means being adapted to control operation of the first projecting means, the second projecting means, the transporting belt means and the rotatable disk so that when the coin detecting means detects an acceptable coin, it does not actuate the first projecting means and the second projecting means, that when the coin detecting means detects an unacceptable coin or a foreign article, it projects the first projecting means or the second projecting means into the coin passage, thereby leading the unacceptable coin or the foreign article to the unacceptable coin collecting means and removing it and that when it is unclear whether or not the coin detected by the coin detecting means is acceptable, it projects the first projecting means and the second projecting means into the coin passage, reversely drives the transporting belt means and the rotatable disk thereby returning the coin onto the rotatable disk, then drives the rotatable disk and the transporting belt means and repeatedly discriminates whether or not the coin is acceptable based on the detected data detected by the coin detecting means until it becomes clear whether or not the coin is acceptable.

2. An unacceptable coin removing apparatus for handling machine in accordance with claim 1 which further comprises reference data storing means for storing reference data relating to coin diameters and coin magnetic properties and wherein the coin detecting means is adapted for detecting coin diameters and magnetic properties and outputting detection signals to the control means and the control means is adapted to read corresponding reference data from the reference data storing means, to compare the thus read reference data with the detected data detected by the coin detecting means and to judge that the coin is acceptable when the detected data relating to coin diameter coincide with the corresponding reference data and the detected data relating to coin magnetic property coincide with the corresponding reference data, that it is unclear whether or not the coin is acceptable when one of the detected data relating to a coin diameter and the detected data relating to coin magnetic property do not coincide with the corresponding reference data and that a detected object is an unacceptable coin or a foreign article when the detected data relating to coin diameter do not coincide with the corresponding reference data and the detected data relating to coin magnetic property do not coincide with the corresponding reference data.

3. An unacceptable coin removing apparatus for a coin handling machine in accordance with claim 2 wherein where the control means judges that a detected object is an unacceptable coin or a foreign article since the detected data relating to coin diameter and the detected data relating to coin magnetic property detected by the coin detecting means do not coincide with the corresponding reference data, the control means is adapted to project the first projecting means into the coin passage when the diameter of the detected object is greater than that of the reference data and to project the second projecting means into the coin passage when the diameter of the detected object is smaller than that of the reference data so as to lead the detected object to the unacceptable coin collecting means and remove it.

4. An unacceptable coin removing apparatus for a coin handling machine in accordance with claim 1 which further comprises denomination setting means for setting a denomination of coins to be handled and reference data storing means for storing reference data relating to coin diameters and coin magnetic properties, the control means being adapted for reading corresponding reference data in accordance with a denomination of coins to be handled set by the denomination setting means, comparing the read reference data with detected data detected by the coin detecting means and judging that the coin is acceptable when the detected data relating to coin diameter coincide with the corresponding reference data and the detected data relating to coin magnetic property coincide with the corresponding reference data, that it is unclear whether or not a coin is acceptable when one of the detected data relating to coin diameter and the detected data relating to coin magnetic property do not coincide with the corresponding reference data and that a detected object is an unacceptable coin or a foreign article when both of the detected data relating to coin diameter and the detected data relating to coin magnetic property do not coincide with the corresponding reference data.

5. An unacceptable coin removing apparatus for a coin handling machine in accordance with claim 4 wherein where the control means judges that a detected object is an unacceptable coin or a foreign article since the detected data relating to coin diameter and the detected data relating to coin magnetic property detected by the coin detecting means do not coincide with the corresponding reference data, the control means is adapted to project the first projecting means into the coin passage when the diameter of the detected object is greater than that of the reference data and to project the second projecting means into the coin passage when the diameter of the detected object is smaller than that of the reference data so as to lead the detected object to the unacceptable coin collecting means and remove it.

6. An unacceptable coin removing apparatus for a coin handling machine in accordance with claim 1 which further comprises reference data storing means for storing reference data relating to coin diameters and coin magnetic property and wherein the coin detecting means is adapted for detecting coin diameters and coin magnetic properties and outputting detection signals to the control means and the control means is adapted to read corresponding reference data from the reference data storing means, to compare the thus read reference data with the detected data detected by the coin detecting means and to judge that the coin is acceptable when the detected data relating to coin diameter coincide with the corresponding reference data and the detected data relating to coin magnetic property coincide with the corresponding reference data, that a coin is an unacceptable coin when the detected data relating to coin diameter coincide with the corresponding reference data but the detected data relating to coin magnetic property do not coincide with the corresponding reference data, that it is unclear whether or not a coin is an acceptable coin when the detected data relating to coin diameter do not coincide with the corresponding reference data and the detected diameter of the coin is equal to or greater than a first predetermined value and is equal to or smaller than a second predetermined value and that the detected object is a foreign article when the detected data relating to coin diameter do not coincide with the corresponding reference data and the detected diameter of the coin is smaller than the first predetermined value and greater than the second predetermined value.

7. An unacceptable coin removing apparatus for a coin handling machine in accordance with claim 6 wherein the control means is adapted to project the first projecting means into the coin passage when it judges that the detected object detected by the coin detecting means is an unacceptable coin, to project the second projecting means into the coin passage when it judges that the detected object is a foreign article and the diameter thereof is smaller than the first predetermined value and to project the first projecting means into the coin passage when it judges that the detected object is a foreign article and the diameter thereof is greater than the first predetermined value, thereby leading the unacceptable coin or the foreign article to the unacceptable coin collecting means and removing it.

8. An unacceptable coin removing apparatus for a coin handling machine in accordance with claim 1 which further comprises denomination setting means for setting a denomination of coins to be handled and reference data storing means for storing reference data relating to coin diameters and coin magnetic properties, the coin detecting means being adapted for detecting coin diameters and coin magnetic properties and outputting detection signals to the control means, the control means being adapted to read corresponding reference data from the reference data storing means in accordance with a denomination of coins to be handled set by said denomination setting means, to compare the thus read reference data with the detected data detected by the coin detecting means and to judge that the coin is acceptable when the detected data relating to coin diameter coincide with the corresponding reference data and the detected data relating to coin magnetic property coincide with the corresponding reference data, that a coin is an unacceptable coin when the detected data relating to coin diameter coincide with the corresponding reference data but the detected data relating to coin magnetic property do not coincide with the corresponding reference data, that it is unclear whether or not a coin is an acceptable coin when the detected data relating to coin diameter do not coincide with the corresponding reference data and the detected diameter of coin is equal to or greater than a first predetermined value and is equal to or smaller than a second predetermined value and that the detected object is a foreign article when the detected data relating to coin diameter to do not coincide with the corresponding reference data and the detected diameter of the coin is smaller than the first predetermined value and greater than the second predetermined value.

9. An unacceptable coin removing apparatus for a coin handling machine in accordance with claim 8 wherein the control means is adapted to project the first projecting means into the coin passage when it judges that the detected object detected by the coin detecting means is an unacceptable coin, to project the second projecting means into the coin passage when it judges that the detected object is a foreign article and the diameter thereof is smaller than the first predetermined value and to project the first projecting means into the coin passage when it judges that the detected object is a foreign article and the diameter thereof is greater than the first predetermined value, thereby leading the unacceptable coin or the foreign article to the unacceptable coin collecting means and removing it.

* * * * *